US011567432B2

(12) United States Patent
Hongo et al.

(10) Patent No.: US 11,567,432 B2
(45) Date of Patent: Jan. 31, 2023

(54) DEVELOPING DEVICE AND IMAGE FORMING APPARATUS HAVING AN OPENING AND CLOSING MEMBER IN A PARTITION BETWEEN CONVEYING MEMBERS

(71) Applicant: FUJIFILM Business Innovation Corp., Tokyo (JP)

(72) Inventors: Mitsutoshi Hongo, Kanagawa (JP); Atsushi Funada, Kanagawa (JP); Tatsuya Tamai, Kanagawa (JP); Mizue Sekine, Kanagawa (JP)

(73) Assignee: FUJIFILM Business Innovation Corn., Tokyo (JP)

( * ) Notice: Subject to any disclaimer, the term of this patent is extended or adjusted under 35 U.S.C. 154(b) by 0 days.

(21) Appl. No.: 17/406,232

(22) Filed: Aug. 19, 2021

(65) Prior Publication Data

US 2022/0373929 A1 Nov. 24, 2022

(30) Foreign Application Priority Data

May 20, 2021 (JP) ..... JP2021-085636

(51) Int. Cl.
*G03G 15/08* (2006.01)

(52) U.S. Cl.
CPC ..... *G03G 15/0891* (2013.01); *G03G 15/0893* (2013.01); *G03G 2215/0822* (2013.01); *G03G 2215/0838* (2013.01)

(58) Field of Classification Search
CPC ..... G03G 15/0891; G03G 2215/0822; G03G 15/0893; G03G 2215/0838
See application file for complete search history.

(56) References Cited

U.S. PATENT DOCUMENTS 5,012,285 A * 4/1991 Oka ..... G03G 15/0822 399/260
9,841,703 B2 * 12/2017 Ishida ..... G03G 15/0891
2007/0098449 A1 * 5/2007 Kadota ..... G03G 15/09 399/258
2007/0274741 A1 * 11/2007 Shiraishi ..... G03G 15/0893 399/254
2009/0214265 A1 * 8/2009 Ikeda ..... G03G 15/0896 399/254
2011/0236074 A1 * 9/2011 Maeda ..... G03G 15/0893 399/256

FOREIGN PATENT DOCUMENTS

JP 2009-175768 A 8/2009

* cited by examiner

*Primary Examiner* — Arlene Heredia
*Assistant Examiner* — Laura Roth
(74) *Attorney, Agent, or Firm* — Sughrue Mion, PLLC

(57) ABSTRACT

Provided is a developing device having a first transport member and a second transport member that are disposed in a first transport path and a second transport path provided at an upper side and a lower side in a gravitational direction. The transport members transport a developer so as to cause the developer to circulate between the first transport path and the second transport path. A partition wall that separates the first transport path and the second transport path from each other and has an opening including an open-close member that opens and closes the opening.

8 Claims, 8 Drawing Sheets

DEVELOPING DEVICE AND IMAGE FORMING APPARATUS HAVING AN OPENING AND CLOSING MEMBER IN A PARTITION BETWEEN CONVEYING MEMBERS

CROSS-REFERENCE TO RELATED APPLICATIONS

This application is based on and claims priority under 35 USC 119 from Japanese Patent Application No. 2021-085636 filed May 20, 2021.

BACKGROUND

(i) Technical Field

The present disclosure relates to developing devices and image forming apparatuses.

(ii) Related Art

Japanese Unexamined Patent Application Publication No. 2009-175768 discloses a developing device that includes a development container, a first agitation member, a second agitation member, and a communication path. The development container has a developing roller that transports a toner to a developing region where an electrostatic latent image is to be developed into a toner image, a developing-roller container that accommodates the developing roller, a first agitation chamber disposed diagonally below the developing-roller container, and a second agitation chamber disposed adjacent to the developing-roller container and above the first agitation chamber. The first agitation member is accommodated in the first agitation chamber and transports the toner in the first agitation chamber in a predetermined first transport direction while agitating the toner. The second agitation member is accommodated in the second agitation chamber and transports the toner in the second agitation chamber in a second transport direction opposite of the first transport direction while agitating the toner. The communication path allows a downstream end of the first agitation chamber in the first transport direction and an upstream end of the second agitation chamber in the second transport direction to communicate with each other so as to transport the toner from the downstream end of the first agitation chamber in the first transport direction toward the upstream end of the second agitation chamber in the second transport direction. In the communication path, a section thereof that is located away from the developing roller relative to a rotation shaft of the first agitation member and that is located closest to the developing roller in a surface of the communication path in contact with the second agitation chamber is provided vertically below the rotation axis of the developing roller.

SUMMARY

With regard to a known type of a developing device, the developing device does not have a developer injected therein before the developing device is to be installed in an image forming apparatus, and the developer is initially injected into the developing device during the installation of the developing device.

Aspects of non-limiting embodiments of the present disclosure relate to a developing device and an image forming apparatus that may allow for easy initial injection of a developer, as compared with a configuration that involves installing the developing device in the image forming apparatus, controlling the driving of transport members, and initially injecting the developer.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device including: a first transport member and a second transport member that are disposed in a first transport path and a second transport path provided at an upper side and a lower side in a gravitational direction and that transport a developer so as to cause the developer to circulate between the first transport path and the second transport path; a partition wall that separates the first transport path and the second transport path from each other and that has an opening; and an open-close member that opens and closes the opening.

BRIEF DESCRIPTION OF THE DRAWINGS

Exemplary embodiments of the present disclosure will be described in detail based on the following figures, wherein.

DETAILED DESCRIPTION

Figure 1:
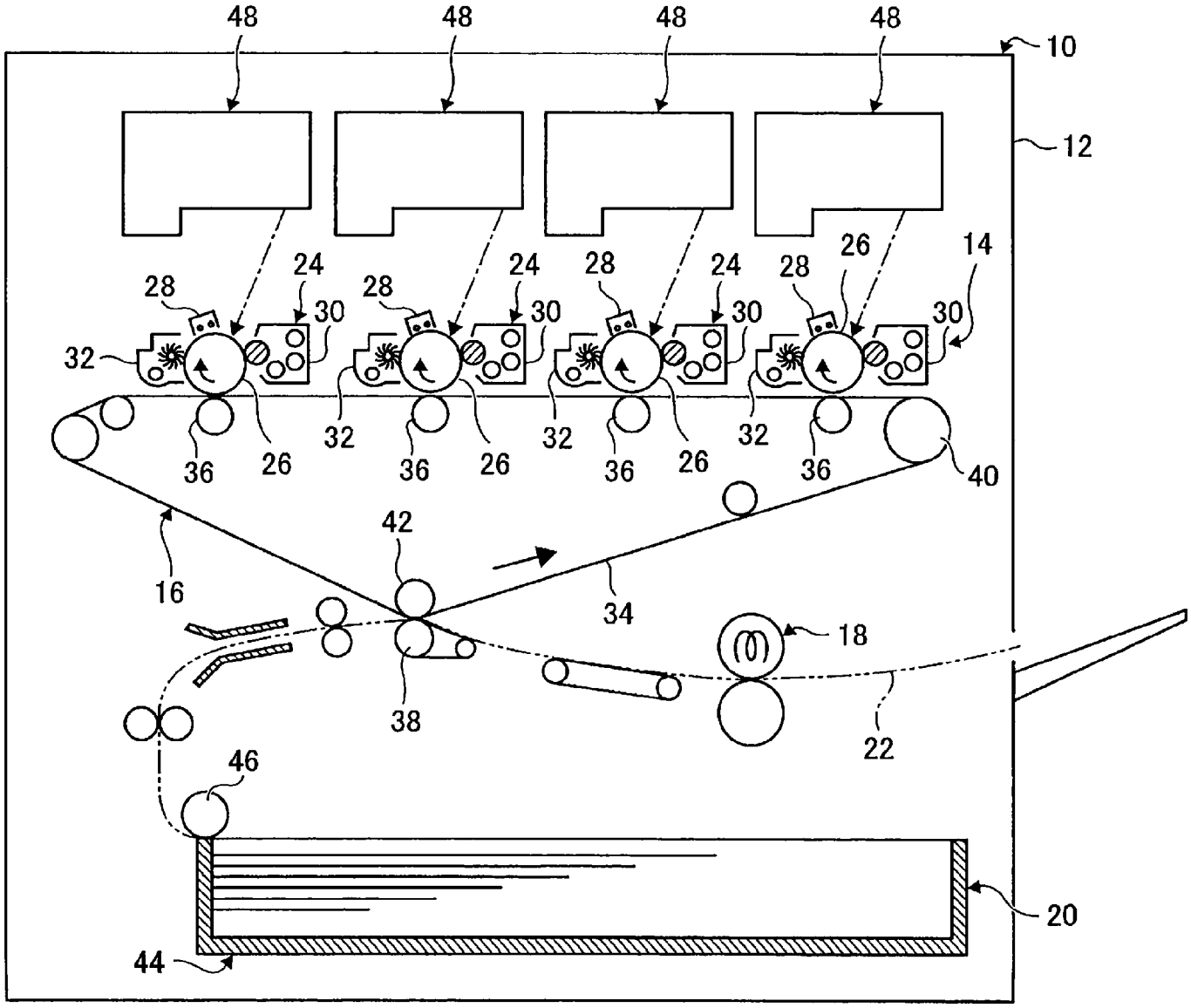
FIG. 1 is a side view illustrating the configuration of an image forming apparatus according to an exemplary embodiment of the present disclosure.

Exemplary embodiments of the present disclosure will now be described with reference to the drawings. FIG. 1 illustrates an image forming apparatus 10 according to an exemplary embodiment of the present disclosure. The image forming apparatus 10 has an image forming apparatus body 12. The image forming apparatus body 12 contains an image forming section 14, a transfer device 16, a fixing device 18, and a sheet feeding device 20. The image forming apparatus body 12 also has a transport path 22 therein for transporting a recording medium, such as a sheet.

The image forming section 14 employs an electrophotographic method to form an image onto the recording medium. The image forming section 14 has multiple image forming units 24, such as four image forming units 24. The four image forming units 24 form toner images of different colors, such as yellow, magenta, cyan, and black colors.

Each image forming unit 24 has a photoconductor drum 26. The photoconductor drum 26 is an example of an image bearing member that rotates while retaining, on the outer peripheral surface thereof, a corresponding toner image to be transferred onto the recording medium. The image forming unit 24 is also provided with a charging device 28 that electrostatically charges the photoconductor drum 26, a developing device 30 that develops an electrostatically-charged latent image by using toner, and a cleaning device 32 that cleans the photoconductor drum 26 after a transfer process. The image forming unit 24 is further provided with an optical writing device 48 that forms a latent image on the electrostatically-charged photoconductor drum 26.

The transfer device 16 has an intermediate transfer belt 34. The intermediate transfer belt 34 receives toner images first-transferred thereto by first transfer members 36 from the respective photoconductor drums 26. The first-transferred toner images are then second-transferred onto the recording medium by a second transfer member 38.

The intermediate transfer belt 34 is supported in a rotatable manner by multiple support members 40. Moreover, a backup member 42 is provided facing the second transfer member 38.

The fixing device 18 fixes the toner images transferred on the recording medium onto the recording medium by using, for example, heat and pressure.

The sheet feeding device 20 has a container 44 that contains a stack of recording media, and also has a delivery member 46 that delivers each recording medium contained in the container 44 toward the transport path 22.

The transport path 22 is used for transporting the recording medium from the sheet feeding device 20 to an area between the second transfer member 38 and the backup member 42, further transporting the recording medium to the fixing device 18, and then transporting the recording medium so as to eject the recording medium outside the image forming apparatus body 12.

In the image forming apparatus 10 having the above-described configuration, the toner images formed on the outer peripheral surfaces of the respective photoconductor drums 26 are first-transferred onto the intermediate transfer belt 34, the toner images first-transferred on the intermediate transfer belt 34 are second-transferred onto the recording medium, and the toner images second-transferred on the recording medium are fixed onto the recording medium by the fixing device 18.

Figure 2:
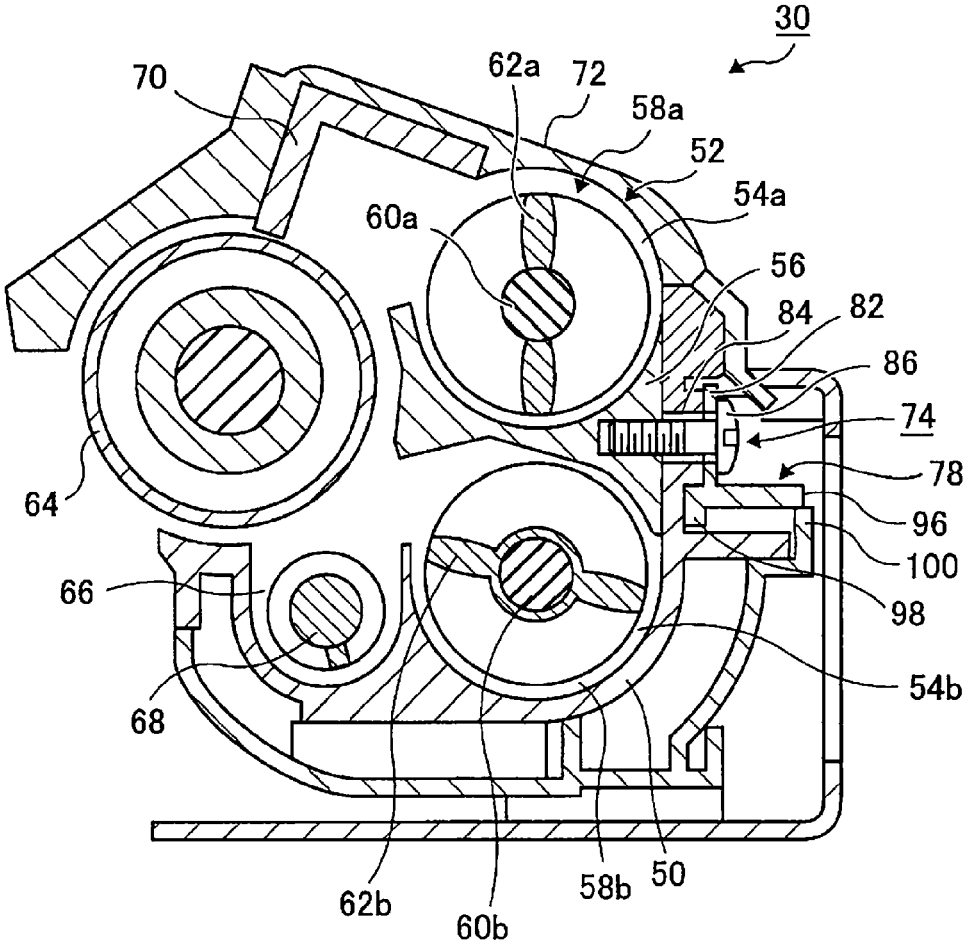
FIG. 2 is a cross-sectional view illustrating a developing device according to an exemplary embodiment of the present disclosure.
Figure 3:
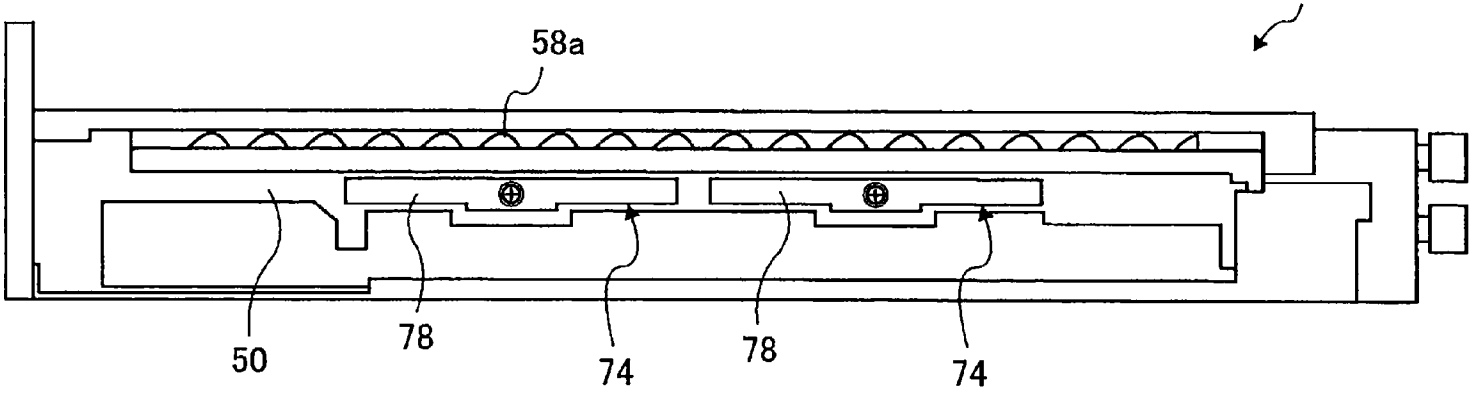
FIG. 3 is a front view illustrating the developing device according to the exemplary embodiment of the present disclosure.
Figure 4:
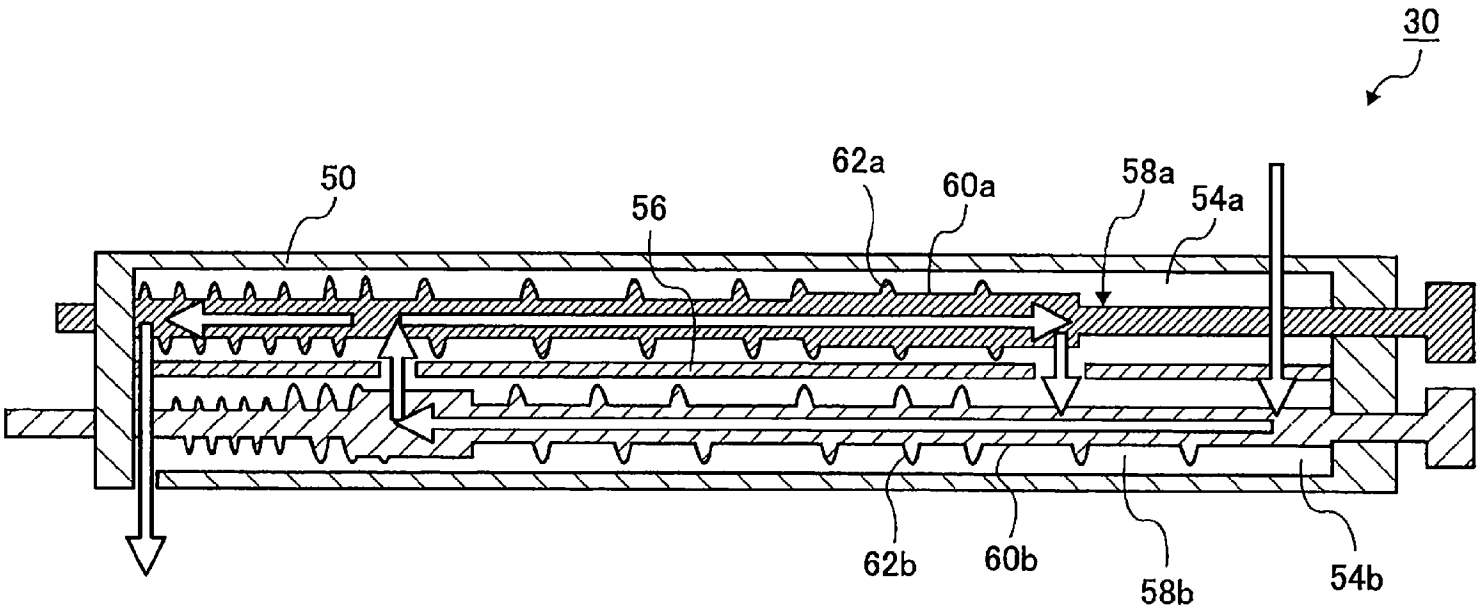
FIG. 4 is a cross-sectional view schematically illustrating the flow of a developer in the developing device according to the exemplary embodiment of the present disclosure.

FIGS. 2 to 4 illustrate each developing device 30.

The developing device 30 is a two-component developing device that performs a developing process by agitating a developer containing a carrier and a toner and electrostatically charging the toner.

The developing device 30 has a developing device body 50. The developing device body 50 is provided with a developer transport section 52 therein. For example, the developer transport section 52 has two transport paths 54*a* and 54*b* that extend in the longitudinal direction of the developing device body 50 and that lie one on top of the other in the gravitational direction. The transport path 54*a* located at the upper side will be defined as a first transport path, whereas the transport path 54*b* located at the lower side will be defined as a second transport path. The transport paths 54*a* and 54*b* are separated from each other in the vertical direction by a partition wall 56. The partition wall 56 has a cross-sectionally circular-arc-shaped upper surface that serves as the lower surface of the first transport path 54*a*. The partition wall 56 also has a cross-sectionally circular-arc-shaped lower surface that serves as the upper surface of the second transport path 54*b*.

The first transport path 54*a* has a first transport member 58*a* disposed therein, and the second transport path 54*b* has a second transport member 58*b* disposed therein. The transport members 58*a* and 58*b* are respectively constituted of rotation shafts 60*a* and 60*b* and helical transport sections 62*a* and 62*b* provided around the rotation shafts 60*a* and 60*b*.

In the developing device body 50, a developing roller 64 is provided alongside the first transport path 54*a*. The developing roller 64 faces the aforementioned photoconductor drum 26 and is configured to move the toner adhered to a magnetic brush provided around the developing roller 64 onto a latent image formed on the photoconductor drum 26. Furthermore, a third transport path 66 is provided below the developing roller 64 in the developing device body 50. The third transport path 66 is provided with a third transport member 68. A thickness regulation member 70 is provided above the developing roller 64 and is configured to regulate the thickness of the developer.

As shown in FIG. 4, in the above-described configuration, the developer is first supplied to one end of the second transport path 54*b*, is supplied to the first transport path 54*a* by the second transport member 58*b* via near the other end of the second transport path 54*b*, is transported to near one end of the first transport path 54*a* by the first transport member 58*a*, so as to circulate between the first transport path 54*a* and the second transport path 54*b*. The first transport member 58*a* rotates clockwise in FIG. 2 so as to transport the developer from the first transport path 54*a* to the developing roller 64, thereby moving the toner adhered to the magnetic brush provided around the developing roller 64 that rotates counterclockwise onto the latent image formed on the photoconductor drum 26. The developer not supplied for the development by the developing roller 64 moves to the third transport path 66, so as to be returned to the second transport path 54*b* by the third transport member 68 that rotates clockwise. The developer returned to the second transport path 54*b* is transported to the first transport path 54*a* by the second transport member 58*b* that rotates clockwise.

Of the developer circulating between the first transport path 54*a* and the second transport path 54*b*, the excess developer is ejected outside the developing device 30 from the other end of the first transport path 54*a*.

Before the developing device 30 is to be installed in the image forming apparatus 10, a predetermined amount of developer has to be initially injected into the developing device 30. If the predetermined amount of developer is to be injected between the first transport path 54*a* and the second transport path 54*b* by removing an upper cover 72 shown in FIG. 2, the injection of the developer into the second transport path 54*b* is difficult.

As shown in FIG. 3, in this exemplary embodiment, two open-close mechanisms 74 used for injecting the developer from the first transport path 54*a* to the second transport path 54*b* are arranged in the longitudinal direction of the developing device body 50.

The open-close mechanisms 74 will be described in further detail with reference to FIGS. 5 to 8.

Each open-close mechanism 74 is constituted of openings 76 provided in the partition wall 56 and an open-close member 78 that opens and closes the openings 76.

Figure 7:
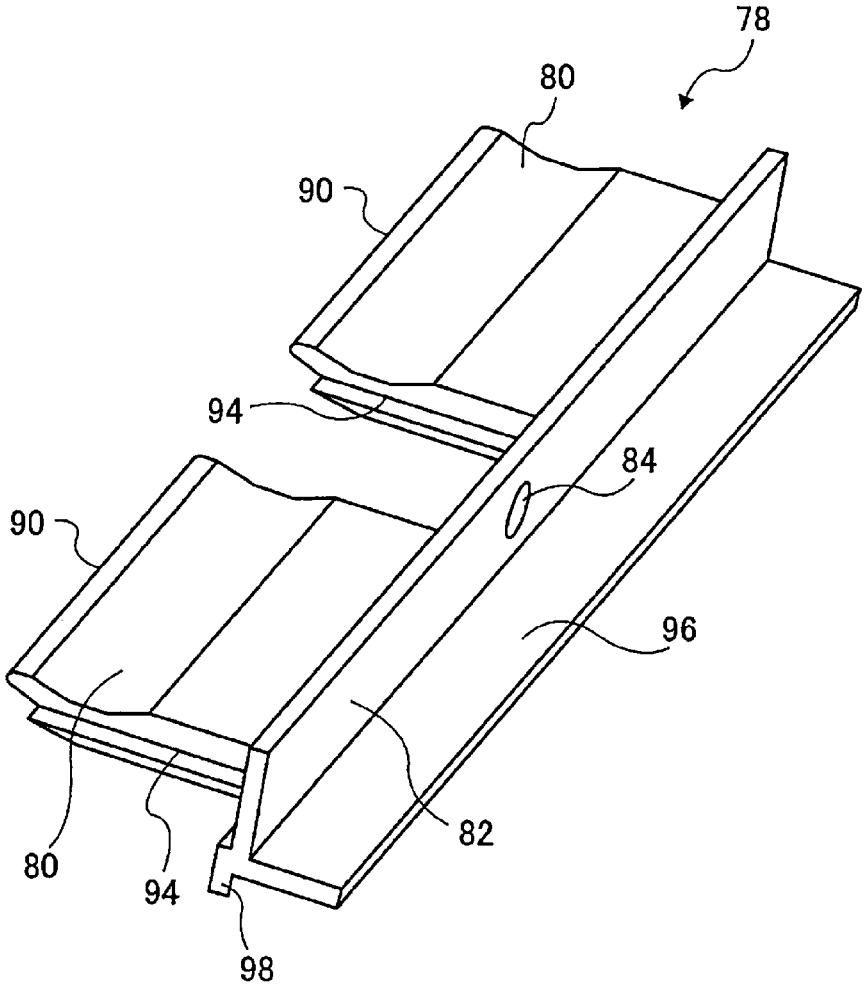
FIG. 7 is a perspective view illustrating the open-close member used in the developing device according to the exemplary embodiment of the present disclosure.
Figure 8:
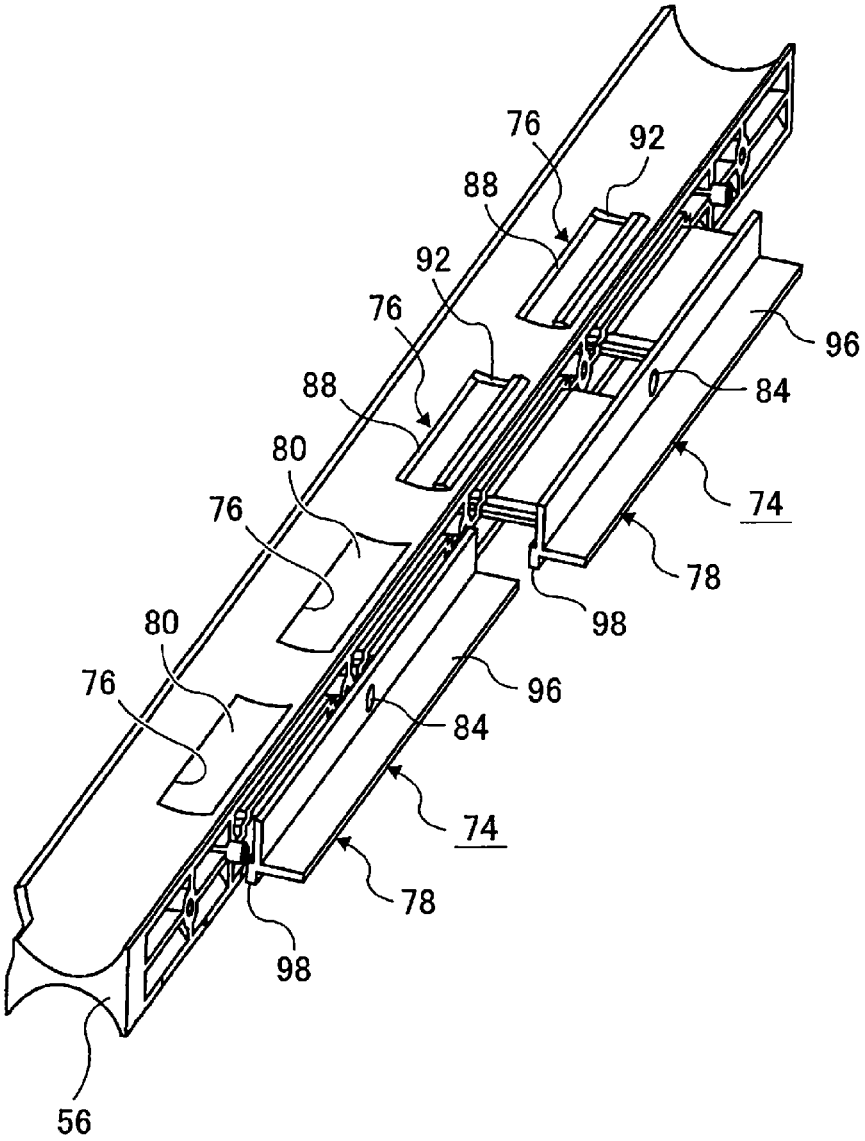
FIG. 8 is a perspective view illustrating a partition wall equipped with open-close mechanisms used in the developing device according to the exemplary embodiment of the present disclosure.

As shown in FIG. 8, two pairs of openings 76, that is, a total of four openings 76, are arranged in the longitudinal direction (i.e., the transport direction of the developer) of the partition wall 56. Two open-close members 78 are provided in the longitudinal direction of the partition wall 56. Each open-close member 78 is split into two open-close-member sections 80 in the longitudinal direction of the partition wall 56. The open-close-member sections 80 correspond to the openings 76. As shown in FIG. 7, the open-close-member sections 80 are connected by a connecting section 82. A side surface of the developing device body 50 and the partition wall 56 are provided with an open-close-member insertion hole 83 to be connected with the openings 76. The open-close-member sections 80 are inserted into this open-close-member insertion hole 83 to block the openings 76, and the connecting section 82 abuts on the side surface of the developing device body 50. A screw hole 84 is provided at the center of the connecting section 82. The open-close member 78 is secured to the developing device body 50 by using a screw 86 inserted into the screw hole 84.

Figure 5:
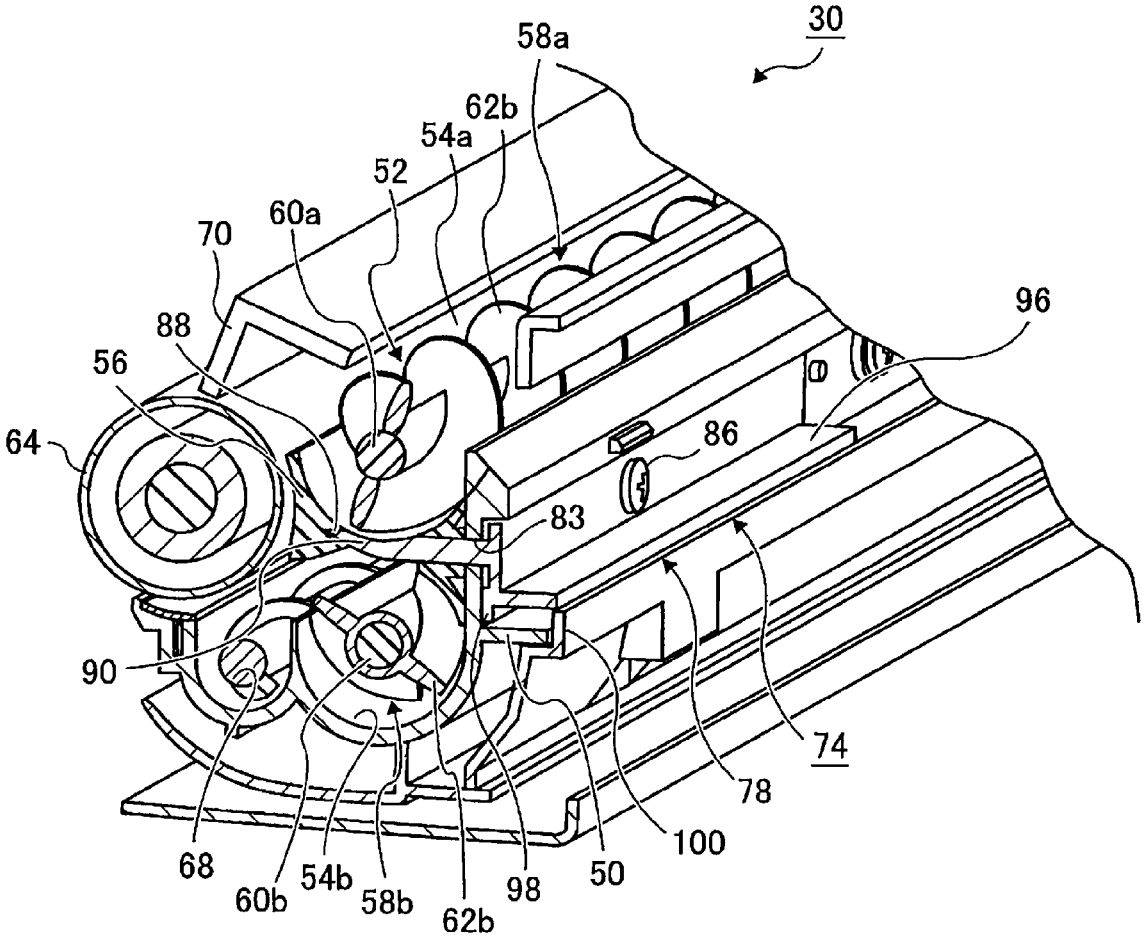
FIG. 5 is a cross-sectional perspective view illustrating a state where an upper cover has been removed from the developing device according to the exemplary embodiment of the present disclosure.
Figure 6:
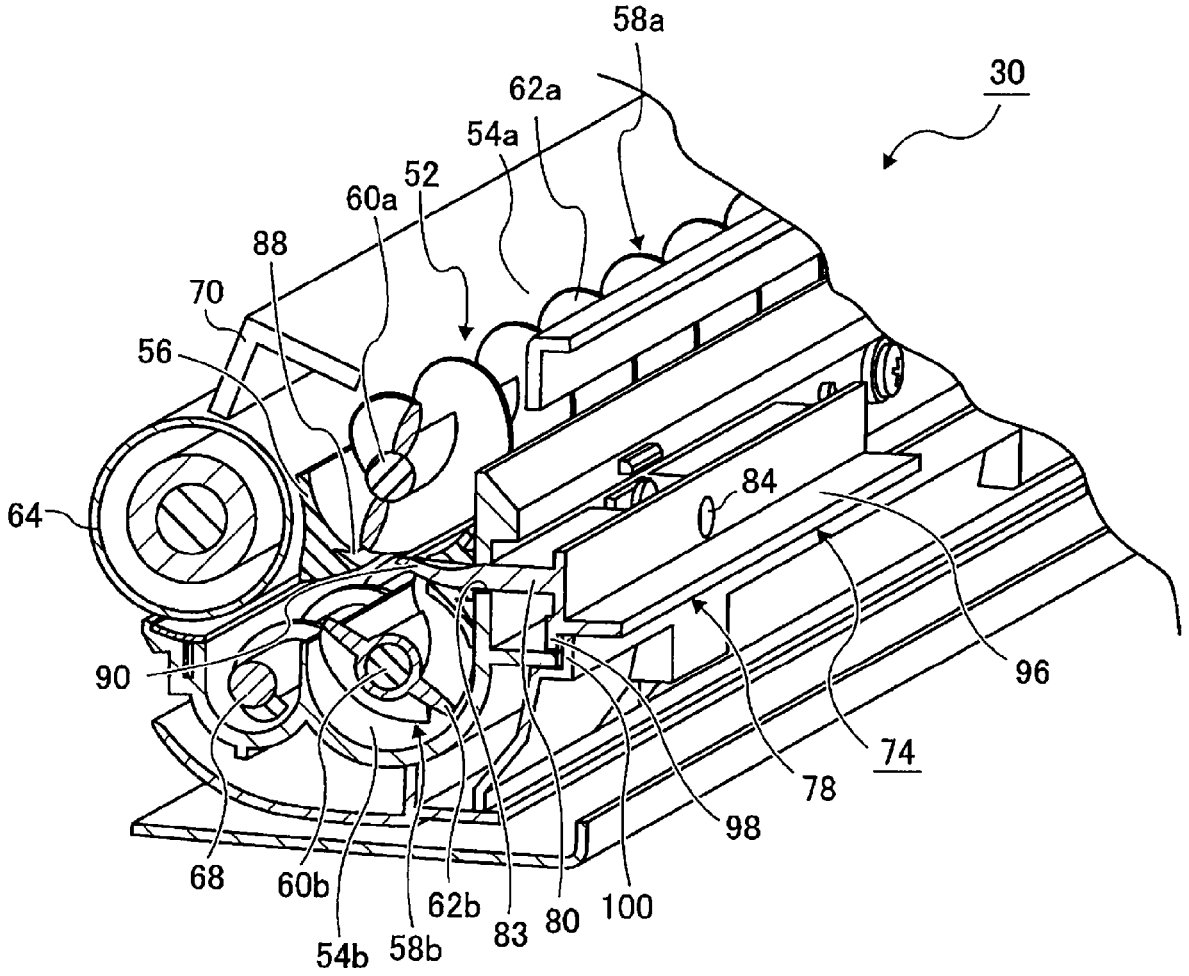
FIG. 6 is a cross-sectional perspective view illustrating a state where the upper cover has been removed and an open-close member has been opened in the developing device according to the exemplary embodiment of the present disclosure.

Each opening 76 is rectangular, as viewed from the gravitational direction. As shown in FIGS. 5 and 6, the counter-insertion side of the opening 76 is provided with an insertion recess 88 recessed into an edge-like shape. On the other hand, the leading edge of each open-close-member section 80 in the insertion direction thereof is provided with an insertion protrusion 90 having an edge-like shape. The insertion protrusion 90 is inserted into the insertion recess 88, so that the open-close-member section 80 is supported by the partition wall 56.

Two edges of each opening 76 opposite each other in a direction orthogonal to the insertion direction are individually provided with opening steps 92. Each opening step 92 has a two-stepped structure such that, in the gravitational direction, the upper step is wider than the lower step. On the other hand, as shown in FIG. 7, two edges extending in the insertion direction of the open-close member 78 are individually provided with open-close-member steps 94. Each open-close-member step 94 has a two-stepped structure such that, in the gravitational direction, the lower step is wider than the upper step. The open-close-member steps 94 engage with the opening steps 92, so that the open-close-member sections 80 are supported by the partition wall 56.

The upper surface of each open-close-member section 80 is recessed in a circular-arc shape so as to accord with the upper surface of the partition wall 56 similarly having a circular-arc shape, in a cross section taken in the direction orthogonal to the transport direction of the developer. Likewise, the lower surface of each open-close-member section 80 accords with the lower surface of the partition wall 56, in a cross section taken in the direction orthogonal to the transport direction of the developer.

A handle 96 protrudes from a side surface of the connecting section 82 of each open-close member 78 described above, such that the open-close member 78 is movable by holding this handle 96. Moreover, a regulating section 98 protrudes downward from the lower surface of the connecting section 82. The regulating section 98 abuts on a stopper 100 provided at the developing device body 50, thereby preventing the open-close member 78 from sliding outward any further.

When the developer is to be initially injected, the developer is injected into the first transport path 54*a* by removing the upper cover 72. In this case, the screws 86 are removed, and the open-close members 78 are moved so that the regulating sections 98 of the open-close members 78 abut on the stopper 100, whereby the openings 76 become fully open. Thus, the developer entering the first transport path 54*a* is injected into the second transport path 54*b* via the openings 76, whereby a predetermined amount of developer is initially injected. Subsequently, the upper cover 72 is attached to the developing device body 50, and the developing device 30 having the upper cover 72 attached thereto is installed in the image forming apparatus 10.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a first transport member and a second transport member that are disposed in a first transport path and a second transport path provided at an upper side and a lower side in a gravitational direction and that transport a developer so as to cause the developer to circulate between the first transport path and the second transport path;

a partition wall that separates the first transport path and the second transport path from each other and that has an opening; and an open-close member that opens and closes the opening wherein the open-close member has at least two open-close-member sections that are split in a transport direction of the developer.

2. The developing device according to claim 1, wherein a lower surface of the partition wall in the gravitational direction and a lower surface of the open-close member in the gravitational direction accord with each other in a cross section taken in a direction orthogonal to a transport direction of the developer, the lower surface of the partition wall constituting the second transport path.

3. The developing device according to claim 1, wherein an upper surface of the partition wall in the gravitational direction and an upper surface of the open-close member in the gravitational direction accord with each other in a cross section taken in a direction orthogonal to a transport direction of the developer, the upper surface of the partition wall constituting the first transport path.

4. The developing device according to claim 3, wherein a lower surface of the partition wall in the gravitational direction and a lower surface of the open-close member in the gravitational direction accord with each other in the cross section taken in the direction orthogonal to the transport direction of the developer, the lower surface of the partition wall constituting the second transport path.

5. The developing device according to claim 1, wherein the split open-close-member sections of the open-close member are connected by a connecting section.

6. The developing device according to claim 5, wherein the connecting section is provided with a regulating section that regulates movement of the open-close member in an opening direction.

7. An image forming apparatus comprising:

a developing device; and a developer bearing member that retains a developer developed by the developing device, wherein the developing device includes:

a first transport member and a second transport member that are disposed in a first transport path and a second transport path provided at an upper side and a lower side in a gravitational direction and that transport the developer so as to cause the developer to circulate between the first transport path and the second transport path;

a partition wall that separates the first transport path and the second transport path from each other and that has an opening; and an open-close member that opens and closes the opening, wherein the open-close member has at least two open-close-member sections that are split in a transport direction of the developer.

8. A developing device comprising:

first transport means and second transport means for transporting a developer so as to cause the developer to circulate between a first transport path and a second transport path, the first transport means and the second transport means being disposed in the first transport path and the second transport path provided at an upper side and a lower side in a gravitational direction;

partition means for separating the first transport path and the second transport path from each other, the partition means having an opening; and open-close means for opening and closing the opening, wherein the open-close member has at least two open-close-member sections that are split in a transport direction of the developer.

* * * * *